United States Patent [19]

Thrift et al.

[11] 4,079,992

[45] Mar. 21, 1978

[54] COMBINED CARRYING CASE AND FOLDING SEAT

[76] Inventors: Marc Thrift, 105 W. 72nd St., Apartment 12C; Sonia Linz, 32 W. 73rd St., Apartment 3R, both of New York, N.Y. 10023

[21] Appl. No.: 756,221

[22] Filed: Jan. 3, 1977

[51] Int. Cl.[2] ..... A47C 4/52

[52] U.S. Cl. ..... 297/183; 297/17

[58] Field of Search ..... 297/129, 193, 17, 118, 297/183, DIG. 2; 190/8

[56] References Cited

U.S. PATENT DOCUMENTS

| | | | |
|---|---|---|---|
| 1,767,925 | 6/1930 | Hargreaves | 190/8 |
| 2,264,774 | 12/1941 | Dunnam | 297/193 X |
| 2,702,076 | 2/1955 | Beardsley et al. | 297/183 X |
| 2,915,154 | 12/1959 | Holder | 297/17 X |
| 3,092,224 | 6/1963 | O'Neil | 297/183 X |
| 3,099,482 | 7/1963 | Woodruff, Sr. | 297/193 |
| 3,422,938 | 1/1969 | Worcester | 297/17 X |
| 3,817,574 | 6/1974 | McNab | 297/17 X |

*Primary Examiner*—James T. McCall
*Attorney, Agent, or Firm*—Caesar, Rivise, Bernstein & Cohen, Ltd.

[57] ABSTRACT

A combination carrying case and folding seat. The device is arranged to be disposed directly on a supporting surface, such as the ground and comprises first and second shell-shaped members. The members are pivotably connected together at their rear by a hinge. The first shell member is generally hollow in shape for storage of items therein and includes a generally planar bottom portion. The generally planar bottom portion serves as the base for the device when disposed on the ground as a seat. The device also includes a third member removably mounted over the first member and closing the hollow interior of the first member. The third member forms a seating surface of the device. The second member includes an inner surface and is pivotable relative to the first member from a closed position wherein the members contact each other to an open position wherein the inner surface of the second member extends at an angle of at least 90° to the seating surface to form a back rest for the seat. Flanges are provided to form a vertical support for the unit when said unit is in its closed position, with one of the flanges serving as a brace for the second member when the device is in its open or seating position. A handle is provided to enable the carrying of the case and locking means are provided to lock the device in its closed position.

7 Claims, 8 Drawing Figures

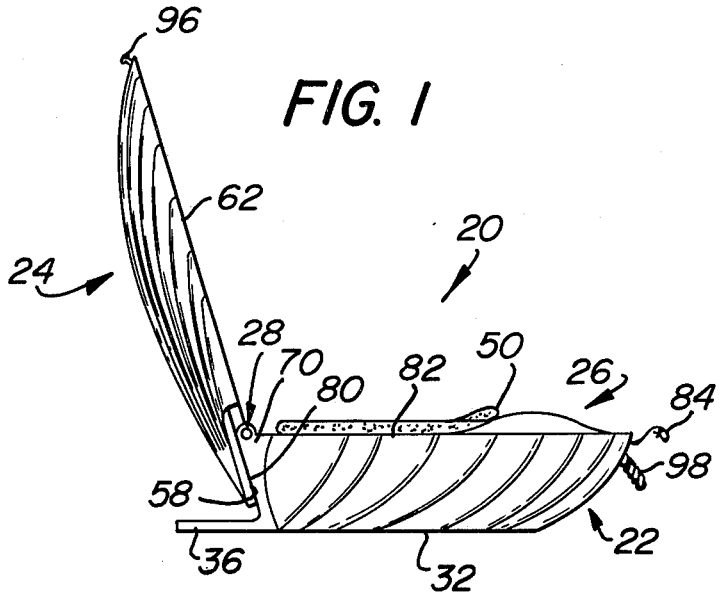
FIG. 1
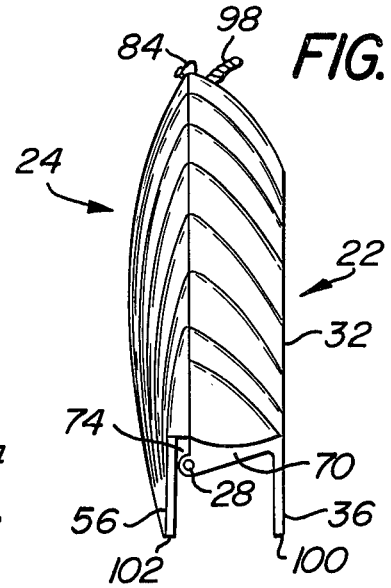
FIG. 2
FIG. 3
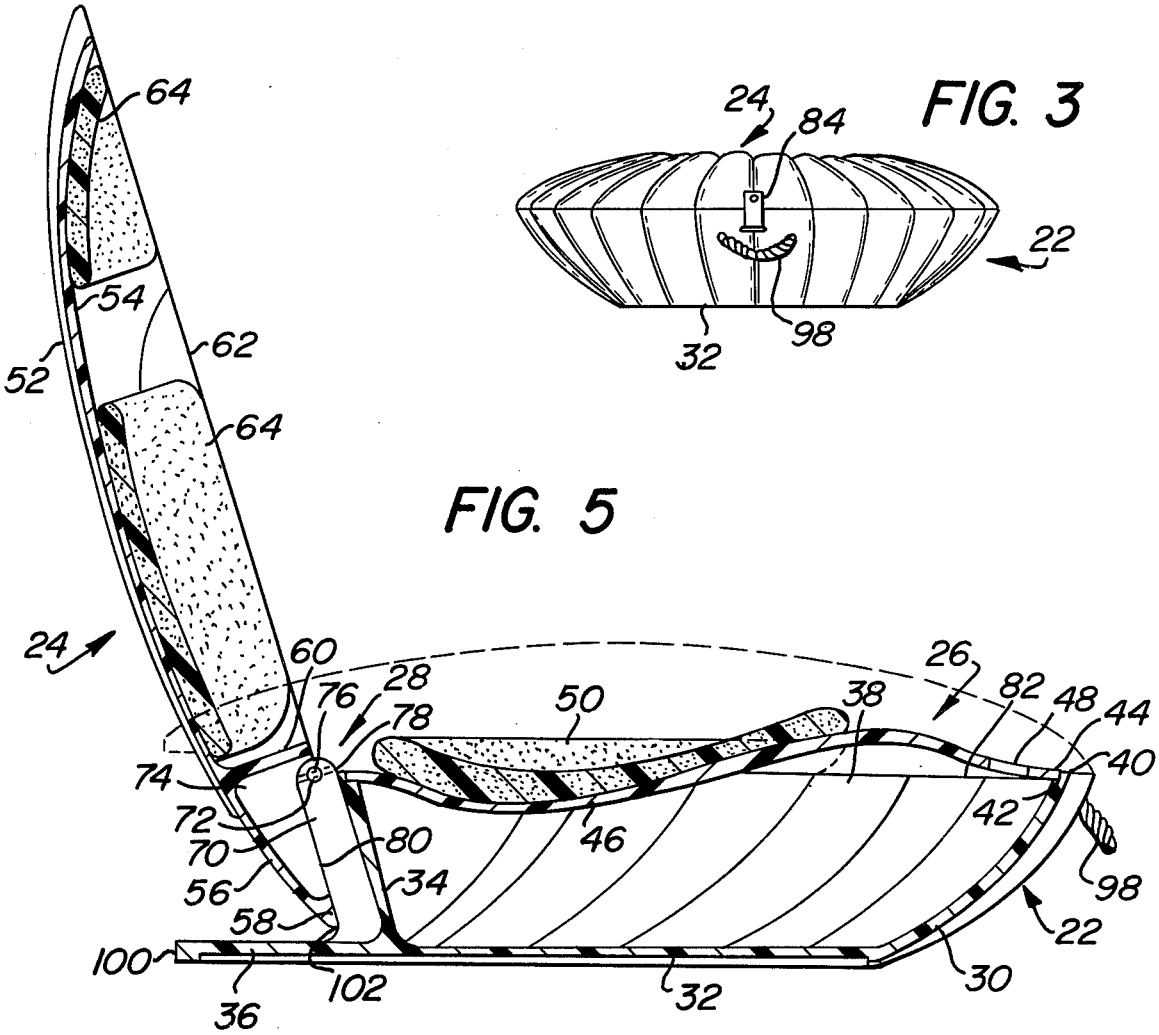
FIG. 5

COMBINED CARRYING CASE AND FOLDING SEAT

This invention relates generally to portable seating devices and more particularly to a combination carrying case and folding seating device which when closed may serve as a case for carrying various small articles and when opened serves as a seat with a firm back rest.

Various portable chairs having seats arranged for disposition direcly upon a supporting surface such as the ground, beach, etc., have been disclosed in the patent literature and some are commercially available. Examples of such prior art chairs are shown in U.S. Pat. Nos. D121,266, D171,506, D194,234, D219,377 and 2,915,154. While such chairs are generally suitable for their intended purpose they leave much to be desired from the standpoint of efficiency and adaptability for multi-purpose use.

In U.S. Pat. No. 3,092,224 (O'Neil) there is disclosed a portable seat which can also serve as a carrying case. To that end, the structure comprises a pair of side walls each having a convex outer surface and a concave inner surface. The side walls are connected together at a hinge and are pivotable from a first position to a second position. The structure includes a handle formed of a pair of frame-like members. One frame member is pivotably connected to one of the side walls and the other frame member is pivotable connected to the other side wall. In the first position the side walls are disposed generally parallel to one another with their peripheral edges abutting, thereby forming a hollow interior case between the concave inner surfaces thereof. In the second position the side walls are pivoted back and one side wall is disposed on the ground with its concave inner surface pointing downward such that its convex surface points upward to form a seating surface. The other side wall is oriented upward at an angle to the downwardly disposed side wall and with its convex surface forming a back rest. The handle of the angularly extending side wall is pivoted to a position wherein it coacts with the other handle to brace the back rest of the seat so formed.

In another U.S. Pat. No. 3,422,938 (Worcester), there is also disclosed a portable seat which can serve as a carrying case. The structure of Worcester comprises a pair of walls having mating peripheral edges. One of the walls forms an inner concavity between its edges. The walls are connected together at a hinge to enable the walls to be swung to a closed position to enclose the concavity and thereby form a storage compartment or to be swung to an open position wherein one of the walls forms a seat and the other wall forms a back rest. A handle is provided to enable the carrying of the device when closed and to aid in the bracing of the wall when it is serving as the back rest.

While the structure of either the O'Neil or Worcester patents appear suitable for use as either a carrying case or a seat, it is clear that these devices can not serve as a storage case and a seat at the same time. To that end, if one wishes to use the device of either O'Neil or Worcester as a seat all the items which were carried in the device when closed must be removed and stored somewhere else before one can sit on the seat. Needless to say, the inability to hold items while serving as the seat as characterizes both the O'Neil or Worcester devices is a decided disadvantage and significantly limits the utility of those devices.

Accordingly, it is a general object of the instant invention to overcome the disadvantages of the prior art.

It is a further object of this invention to provide a device forming a comfortable seat and back rest with firm support which can be readily converted to a simple folding carrying case with substantial internal storage space.

It is still a further object of this invention to provide a folding carrying case and seat wherein when the seat is arranged for seating purposes items may still be stored safely therein.

It is a yet further object of this invention to provide a small and lightweight combination folding seat and carrying device.

It is yet a further object of this invention to provide a readily portable seat and carrying case of significantaesthetic appeal.

These and other objects of the instant invention are achieved by providing a combination carrying case and folding seat for disposition directly upon a supporting surface. The device comprises first and second shell-shaped members which are pivotably connected together at a hinged joint. A third member is disposed between the first and second members. The first member is generally hollow in shape for holding items therein and includes a generally planar surface forming a base for the seat. The third member is removably mounted over the first member, closing the hollow interior thereof and forming a seating surface of the seat. The second member has an inner surface and is pivotable relative to the first member about the hinge from the closed position wherein the members contact each other to an open position wherein the inner surface of the second member extends at an angle of at least 90° to the seating surface to form a back rest for the seat.

Other objects and many of the attendant advantages of the instant invention will be readily appreciated as the same becomes better understood by reference to the following detailed description when considered in connection with the accompanying drawing wherein:

FIG. 1 is a side elevational view of a combined seat and carrying case in accordance with the instant invention showing the device in its open position arranged to serve as a seat;

FIG. 2 is a side elevational view of the device of FIG. 1 shown in its closed position and disposed vertically ;

FIG. 3 is a front elevational view of the device of FIG. 1 in its closed position and disposed horizontally;

FIG. 5 is an enlarged side elevational view, partially broken away, of the device of FIG. 1 in its open position and showing various internal details thereof;

Figure 6:
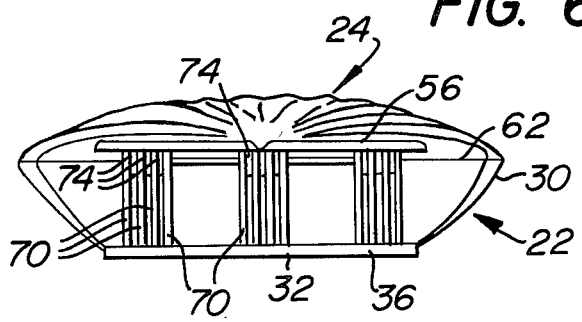
FIG. 6 is an end elevational view of the device of FIG. 1.

Referring now to the various figures of the drawing wherein like reference characters refer to like parts there is shown in FIG. 1 an improved combination carrying case and folding seat 20. The device basically comprises a first shell-like member 22 and a second shell-like member 24. A third member 26, as will be seen in detail hereinafter, is disposed between the members 22 and 24 and is mounted on member 22. The member 24 is pivotably connected to member 22 by a hinge 28, such that member 24 can be pivoted from the closed position shown in FIGS. 2, 3 and 6 to the open position shown in FIGS. 1 and 5. As will be described in detail later, when the device 20 is in its closed position it serves as a carrying and/or storage case. When the device is in its open position it serves as a seat as well as a storage case.

Turning now to FIG. 5 the details of the shell members 22 and 24 will be described. The member 22 is of generally hollow shape and includes a side wall 30 and a generally planar bottom wall 32. The back portion 34 of the side wall 30 is generally planar. A flange 36 projects backward from the bottom wall 32 and is coplanar therewith. The side wall 30 and the bottom wall 32 of member 22 form a hollow interior portion or cavity 38. Cavity 38 serves as the storage compartment for articles (not shown) which are to be stored and carried within the seat 20. The free edge 40 of the side wall of member 30 includes a ledge 42 extending along the entire periphery of the side wall. The ledge serves as a supporting surface for the member 26. To that end, member 26 is suitably dimensioned so that its peripheral edge 44 lies on and is supported by ledge 42. As will be appreciated by those skilled in the art, with the member 26 in the position shown in FIG. 5 the article storage compartment 38 is sealed. In accordance with a preferred aspect of the instant invention member 26 is contoured so as to provide a comfortable seat. To that end, member 26 includes a depressed portion 46.

In order to provide accessibility to storage compartment 38 member 26 is removable. To that end, a finger hole 48 is provided closely adjacent to the portion of the peripheral edge 44 at the front of the member 26.

As a further comfort aid a cushioned pad 50 may be provided and disposed over depressed area 46 of member 26.

As should be appreciated, since member 26 serves as both the seat and the closure for the storage compartment 38, the device of the instant invention can be used as a seat and as a storage unit at the same time, thereby enabling the device 20 to have wide utility.

Figure 7:
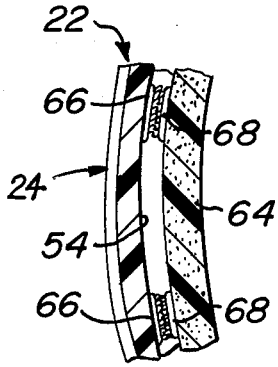
FIG. 7 is a sectional view of a portion of the device shown in FIG. 5.

As noted heretofore, the member 24 is pivotable to an open position, e.g., at least 90° with respect to seat member 26, such that it serves as the back rest for the seat 20. As can be seen in FIG. 5, member 24 is a curve-shaped member including a generally convex outer surface 52 and a generally concave inner surface 54. The rear of the member 24 is in the form of a projecting flange 56 and which is an extension of surface 52. The free edge of flange 56 is in the form of an enlarged lip 58. A rib 60 projects from surface 54 and is dimensioned such that it terminates in the plane of the peripheral edge 62 of member 24. As will be described in detail later, portions of the hinge 26 project from rib 60 of member 24 and pivotably coact with similar projections from back wall 34 of member 22. The inner surface 54 of member 24 is concave so as to provide a comfortable back rest when the seat 20 is in the open position shown in FIG. 5. For additional comfort the back rest may include pads 64 thereon. The pads are held in position, via VELCRO fastening tape. To that end, as can be seen in FIG. 7, patches 66 of one component of VELCRO fastening tape are permanently secured to the inside surface 54 of member 24 while the patches of cooperating components 68 of the VELCRO fastening tape are permanently secured to the back surfaces of pads 64. The hooks and loops of the VELCRO fastening tape interengage to securely hold the pads 64 in place. Removal of the pads can be readily accomplished by pulling on the pads, thereby separating the hooks and loops of the fastening tape.

The hinge 28 comprises a plurality of ribs 70 which project outward from the back outer surface of back wall 34 of member 22. An opening 72 is provided in the top portion of each rib, with the openings in each member 70 being axially aligned. A plurality of rib-like projections 74 extend from the back surface of rib 60 and are spaced so as to be interposed between ribs 70 of member 22. Each of the ribs 74, like ribs 70, include an opening (not shown) therein. The openings are axially aligned with one another and with the openings 72 in ribs 70. A pivot rod 76 extends through the axially aligned openings in ribs 70 and 74 and serves as the axis about which member 24 pivots. The rod 76 is held axially in place via a radially extending positioning pin 78. Accordingly, the ribs 70 serve as one portion of hinge means 28 while the ribs 74 serve as the cooperating portion of the hinge means.

As can be seen in FIG. 5, the enlarged lip 58 at the back edge of the flange 56 of member 24 is adapted to make contact with the rear edge 80 of the projecting ribs 70. To that end, edge 80 serves as an abutment or stop precluding the member 24 from pivoting too far backward. This feature has the effect of ensuring that the member 24, which serves as the back rest, is braced against backward deflection when the user is eated on the seat 20 and against the back rest 24.

When it is desired to close the device 20 member 24 is pivoted from the open position (shown in full in FIG. 5) to the closed position (shown in phantom in FIG. 5). In the closed position the peripheral edge 62 of member 24 abuts the peripheral edge 82 of the hollow member 22.

Figure 8:
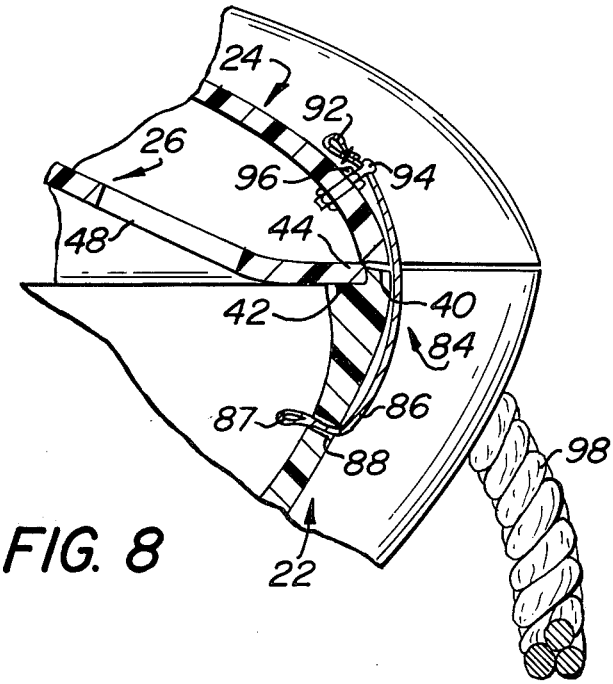
FIG. 8 is an enlarged view, partially in section, showing the securing means shown in FIG. 3 which holds the device in its closed position.

In order to secure the portions 22 and 24 together when the seat 20 is in the closed position locking means is provided. The locking means is in the form of a clasp 84 mounted on the front of the chair. To that end, as can be seen in FIG. 8, the clasp 84 comprises a flexible strap 86 having one end extending through an opening 88 in the front of the side wall 30 of member 22. The end of strap 86 is enlarged 87 to preclude its removal from opening 88. The other end of strap 86 includes a grasping tab 92 and an opening 94 disposed immediately adjacent thereto. The opening is adapted to engage a mating snap 96 mounted on the member 25 adjacent the front thereof.

As will be appreciated by those skilled in the art, by merely pulling on tab 92 the snap is disconnected, thereby permitting the member 24 to be pivoted back to the open position shown in FIG. 5. Conversely, when it is desired to secure the closed seat 20 the strap 86 is moved to a position such that the snap 96 is disposed within the opening 94.

In order to effect the ready transportability or lifting of the seat 20 handle means is provided adjacent to the clasp 84. To that end, the handle is in the form of a bail 98 which is secured at each end to the side wall 30 of the member 22.

As can be seen in FIGS. 2 and 3, the device 20, when closed, is adapted to be disposed either horizontally (FIG. 3) or vertically (FIG. 2). In the horizontal orientation the planar bottom wall 32 of the device is disposed upon the supporting surface (not shown). In the veritcal orientation the device 20 is supported by the projecting flanges 36 and 56. To that end, as can be seen in FIG. 2, flange 36 and flange 56 project the same distance back so that their free edges 100 and 102, respectively, are coplanar, thereby forming a base for supporting the unit vertically. As will be appreciated by those skilled in the art, the ability to store the device 20 vertically is of considerable importance in that it enables one to lift the device its handle 98 without having to bend over.

Figure 4:
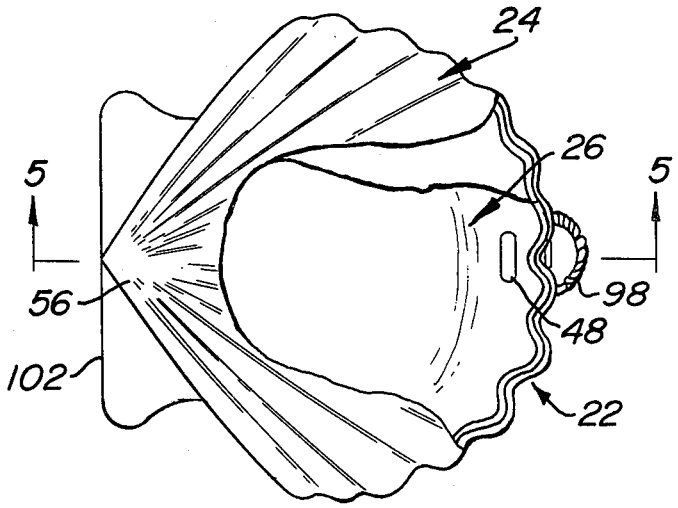
FIG. 4 is a plan view, partially broken away, of the device of FIG. 1.

In order to provide an aesthetically pleasing appearance, in the embodiment of the invention shown herein, the outer surfaces of the members 24 and 30 are sculptured e.g. undulating such that said members each simulate a scallop-type shell (see FIGS. 1, 3 and 4).

It must be pointed out at this juncture that various other sculptured effects may be used to simulate other types of mollusk shells. Furthermore, in lieu of the use of sculptured surfaces, it is contemplated that the surfaces of the members 22 and 24 be smooth with markings or shadings provided thereon simulating the sculptured effect of a mollusk shell.

In accordance with a preferred aspect of this invention the device 20 is formed of a plastic, with the members 22, 24 and 26 each being formed as an integral unit as by molding or casting.

As should be appreciated from the foregoing the combination seat and carrying case of the instant invention, when closed, has wide utility since it may serve as a case for carrying various small articles, such as beach or pool apparel and equipment and, when opened, may serve as a seat with a firm back rest. In addition, the simple construction features of the device render it inexpensive to manufacture, while being compact, lightweight, durable and attractive. In regard to the latter, the simulation of a mollusk shell provides considerable aesthetic appeal particularly in common outdoor applications such as beach or pool use. Most importantly, the ability to contain various personal beach or pool articles within the seat while it is actually in use as a seat provides considerable appeal since this feature enables the articles to be protected from the natural environment, neglect or loss at all times and without additional receptacles. Access to the articles is accomplished quickly and easily by the mere removal of the seating surface. Further still, the ability of the device to be stored vertically (upright) renders the device readily portable via its handle.

Without further elaboration, the foregoing will so fully illustrate my invention that others may, by applying current or future knowledge, readily adapt the same for use under various conditions of service.

What is claimed as the invention is:

1. A combination carrying case and folding seat for disposition directly on the ground and comprising first and second shell-shaped members having undulating external wall portions and being pivotably connected at a hinge joint and a removable third member disposed between said first and second members, said first member being generally hollow in shape for holding items therein and including a generally planar surface forming a base for said seat, the wall portion of said first member having a peripheral free edge, the inner periphery of said free edge including a peripheral ledge extending therealong, said third member being mounted over said first member and supported thereon only by said ledge, said first member having a flange projecting beyond the wall thereof adjacent to said hinge and said second member having a flange projecting therefrom adjacent to said hinge, said third member closing the hollow interior of said first member and forming a seating surface of said seat, the wall portion of said second member including a peripheral free edge, said second member having an inner surface and being pivotable relative to said first member about said hinge from a closed position wherein the free edges of said first and second members contact each other to an open position wherein the inner surface of said second member extends at an angle of at least 90° to said seating surface to form a back rest for said seat, said flanges projecting approximately the same distance to form a base for storing the seat in a vertical orientation when the seat is in said closed position, the flange of the second member serving to abut a portion of the first member when said seat is in said open position to brace the second member in said open position.

2. The seat of claim 1 additionally comprising locking means for securing said first and second members together when said seat is in said closed position.

3. The seat of claim 1 wherein said seat is formed of plastic.

4. The seat of claim 3 wherein the undulating wall portions of said first and second members gives the appearance of a mollusk shell, with said undulating portions providing additional support for a person seated on said seating surface.

5. The seat of claim 1 additionally comprising handle means for carrying the seat.

6. The seat of claim 1 wherein said third member is contoured to include a depressed portion providing a comfortable seating surface.

7. The seat of claim 6 wherein said hinge is formed integrally with said first and second members.

* * * * *